United States Patent [19]

Thiruvengadam et al.

[11] 4,193,635

[45] Mar. 18, 1980

[54] CONTROLLED CAVITATION EROSION PROCESS AND SYSTEM

[76] Inventors: Alagu P. Thiruvengadam, 10509 William Tell La., Columbia, Md. 21044; Ambrose A. Hochrein, Jr., 18521 Kilt Ter., Olney, Md. 20832

[21] Appl. No.: 894,557

[22] Filed: Apr. 7, 1978

[51] Int. Cl.[2] ..... E21C 25/60; B08B 3/12

[52] U.S. Cl. ..... 299/17; 134/1; 175/67

[58] Field of Search ..... 299/14, 17; 175/67, 175/422; 134/1; 239/102

[56] References Cited

U.S. PATENT DOCUMENTS

| | | | |
|---|---|---|---|
| 3,373,752 | 3/1968 | Inoue | 134/1 |
| 3,713,699 | 1/1973 | Johnson | 299/17 X |
| 4,081,200 | 3/1978 | Cheung | 299/17 |

*Primary Examiner*—Ernest R. Purser

*Attorney, Agent, or Firm*—Burns, Doane, Swecker & Mathis

[57] ABSTRACT

A process and apparatus for high speed material removal with relatively low specific energy input requirements are disclosed. The apparatus includes a system for supplying pressurized fluid at a predetermined flow rate and pressure to an orifice of predetermined diameter. The system establishes a fluid flow to an environment in which there exists cavitation downstream of the orifice. The orifice size, position relative to the surface being treated, the fluid velocity and fluid pressure are determined with reference to the erosion strength of the particular parent material to be removed so as to effect highly efficient rapid cutting, drilling, cleaning and the like. The process includes the generation of a cavitation-free fluid flow through the orifice such that a submerged cavitating flow field is established downstream of that orifice. The velocity of fluid flowing through the orifice is selected to provide a cavitation intensity which exceeds the threshold erosion intensity of the material to be removed. As the cavitation bubbles collapse, the material is removed to selectively clean, cut or drill, as required.

17 Claims, 12 Drawing Figures

Fig. 1
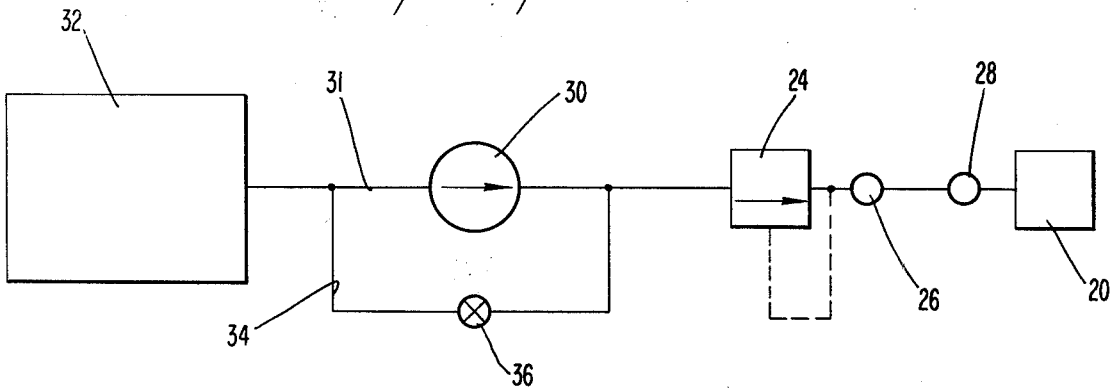
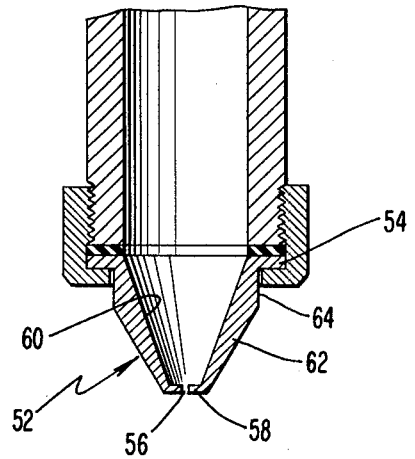
Fig. 3
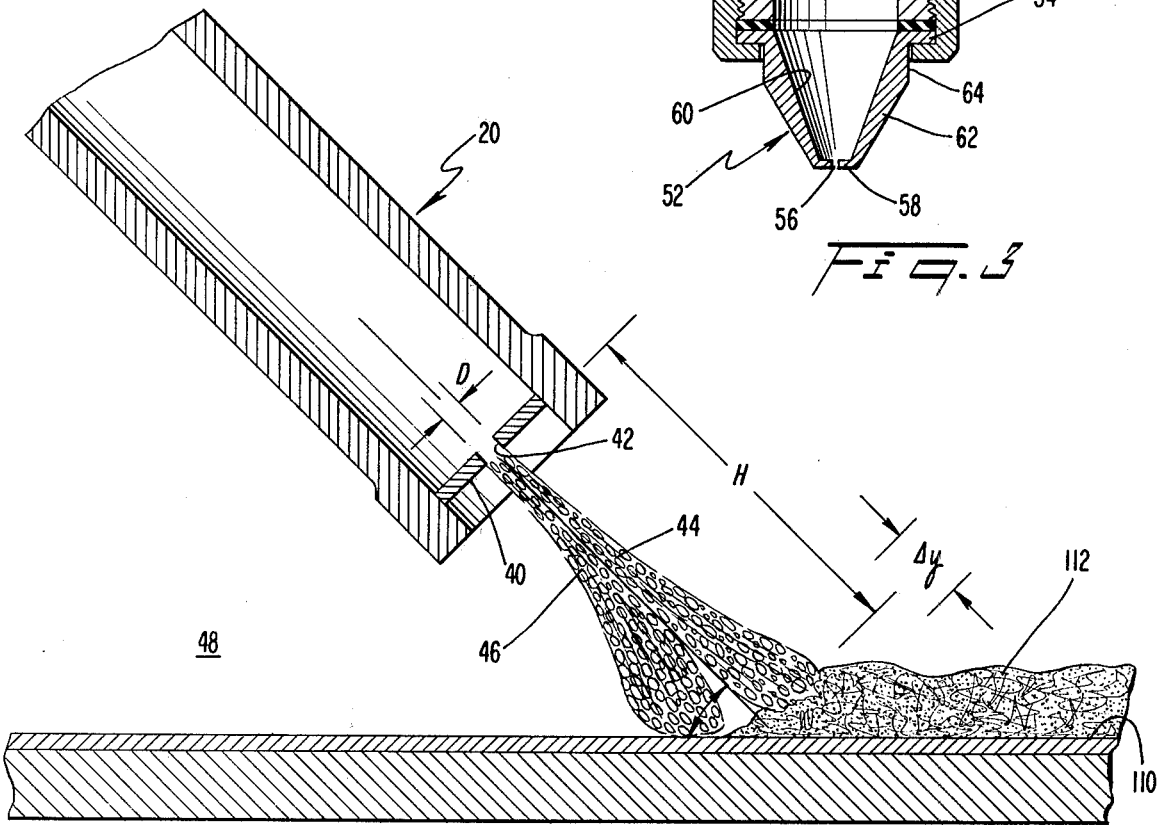
Fig. 2

Fig. 6
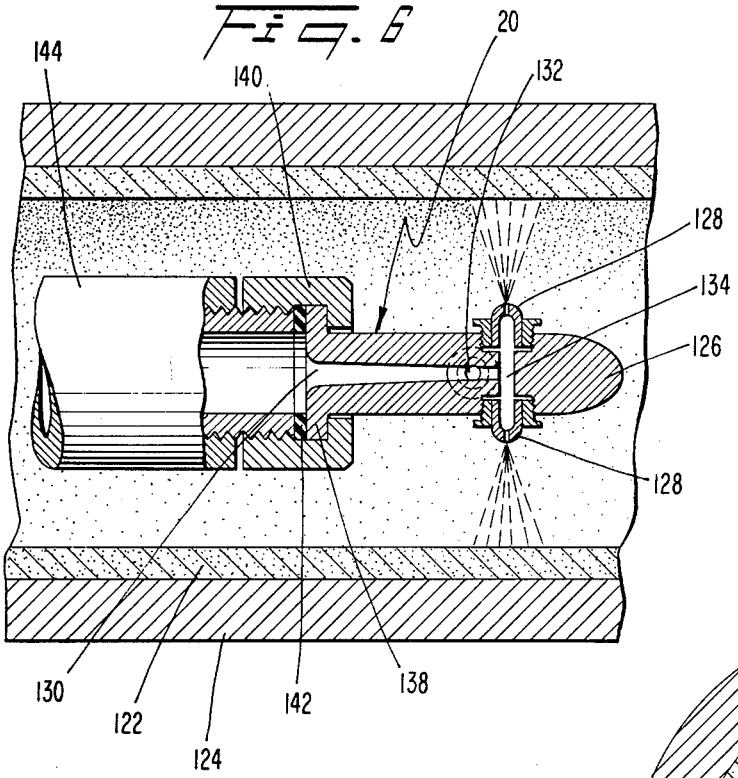
Fig. 7
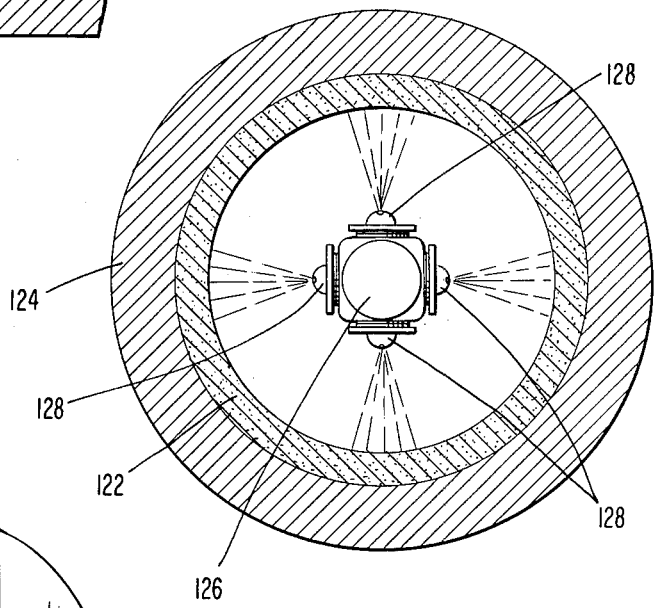
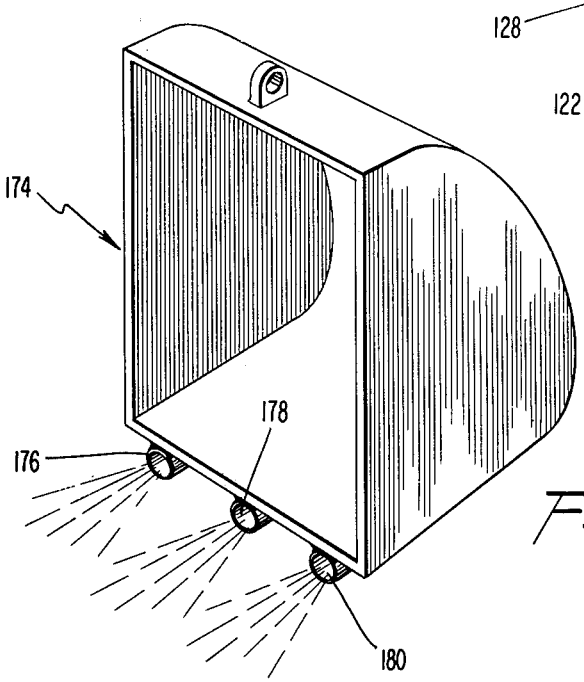
Fig. 10

CONTROLLED CAVITATION EROSION PROCESS AND SYSTEM

BACKGROUND OF THE INVENTION

The present invention relates generally to removing material from a body of the same or dissimilar material. More particularly, the present invention concerns the controlled removal of material utilizing cavitationally induced material erosion.

The phenomenon of cavitation of dynamic fluid systems is not new. Cavitation and the associated erosion has been treated as a problem that is common to many complex engineering applications. Typically, cavitation is a phenomenon which is to be avoided because it results in rapid deterioration and failure of adjacent solid surfaces. To be sure, there have been attempts to use the destructive characteristics of cavitation to accomplish a useful purpose. For example, cavitating fluid flows have been used in order to drill holes through comparatively solid material. See, for example, U.S. Pat. No. 3,528,704 issued to Johnson, Jr. Moreover, the task of drilling with a nonsubmerged cavitating jet surrounded by a fluid sheath, has also been considered. See, for example, U.S. Pat. No. 3,807,632 issued to Johnson, Jr.

The cavitation phenomena has also been used generally in bore hole drillings for removal of mineral deposits far below the earth surface. See, for example, U.S. Pat. No. 3,603,410 issued to Angona, U.S. Pat. No. 3,545,552 issued to Angona and U.S. Pat. No. 3,387,672 issued to Cook. The more conventional rotary drilling techniques in bore hole drilling have been used with an artificially induced cavitational flow in the form of evacuated capsules to cavitationally augment the rotary drilling process. See, for example, U.S. Pat. No. 3,174,561 issued to Sterrett.

The known approaches to cavitationally augmented drilling techniques are, however, fraught with numerous problems. For example, the known devices for drilling are not adapted for other material removing functions such as cutting, cleaning, trenching and the like. Similarly, the known devices operate very inefficiently and have massive input power requirements. In another vein, known cavitational processes do not exhibit the ability to selectively remove one material from a second material. Such problems as those enumerated above are of particular importance when one considers the problems such as removal of boiler scale without disassembling the boiler, the cleaning of large surfaces such as runways, and removal of marine growth from seagoing vessels without dry docking the vessel.

In conventional apparatus for drilling, cutting and cleaning a material, there is mechanical interaction between the tool of the apparatus and the material. Such mechanical interaction either limits the useful life of the tool or results in a reduction in the useful life of the tool. This life reduction is directly attributable to the mechanical wear induced by friction between the material and the tool. To avoid such deleterious interaction, it is necessary to decouple the cutting element from the material.

In addition to the problems discussed above, the prior art cavitational devices require massive input power sources, use large flow rates of the cavitating medium, have unacceptably slow material removal rates and generally fail to appreciate and utilize the full potential of a cavitating flow system.

In view of the foregoing discussion, it will be apparent that the need continues to exist for a truly effective cavitational system for removing material which is capable of performing such machining functions as cutting, drilling and cleaning.

SUMMARY OF THE INVENTION

In accordance with the present invention, problems of the type discussed above in connection with the prior art are overcome by positioning an orifice of a predetermined size at a preselected distance from the material to be selectively removed. With the orifice in position, a cavitation-free fluid flow is generated through the orifice. In this manner, the orifice is not subjected to the deleterious effects of a cavitating flow. However, simultaneously with the establishment of the cavitation-free flow through the orifice, a submerged jet is defined having sufficiently large transverse velocity gradients to induce a velocity shear layer with sufficient intensity that a cavitational flow field is developed in a free turbulent shear layer downstream of the orifice.

The velocity of fluid flowing through the orifice is adjusted to provide a selected cavitation intensity. The cavitation intensity is selected to exceed the threshold erosion intensity of the material to be removed. As bubbles generated in the cavitating flow field progress toward the material and collapse, a controlled intensity erosion occurs whereby material is selectively loosened and removed.

Where the material is to be removed from a second dissimilar underlying material, the cavitation intensity of the flow field is selected so as to lie above the cavitation erosion intensity of the first material, which is to be removed, and well below the cavitation erosion intensity of the underlying parent material. In this fashion, the first material can be selectively removed without damage to the underlying parent material. Such a procedure is of great value in the in situ cleaning of one material from a second material. For example, the removal of boiler scale from the interior of boiler heat transfer tubes and the removal of marine growth from the exterior surface of a ship hull may be effected with great utility.

Where it is desired to drill a hole in the material, the orifice and its downstream cavitating flow field may be advanced toward the material at a constant rate so that the collapsing cavitation bubbles impinge upon the material with maximum intensity to quickly erode a hole through the material.

Where it is desired to cut a material, the orifice may be moved along the contour line to be cut in such a manner as to maintain its distance from the surface at a uniform value. In this fashion, the maximum intensity of erosion can be positioned so as to cut the material along the selected contour at a very rapid rate.

BRIEF DESCRIPTION OF THE DRAWINGS

Many objects and advantages of the present invention will be apparent to those skilled in the art when this specification is read in conjunction with the drawings wherein like reference numerals are applied to like elements and wherein:

FIG. 1 is a schematic illustration of the apparatus required to practice the present invention;

FIG. 2 is a detail view of a nozzle suitable for use in connection with the apparatus of FIG. 1 and used to remove one material from a second material;

FIG. 3 is an alternate embodiment for the nozzle which is suitable for use with the apparatus of FIG. 1;

FIG. 6 is a partial cross-sectional view of a plurality of nozzles mounted for in situ cleaning of a conduit;

FIG. 7 is an end elevation of the apparatus of FIG. 6;

FIG. 10 is a pictorial view of a trenching bucket with cavitational augmentation.

DESCRIPTION OF THE PREFERRED EMBODIMENTS

Figure 4:
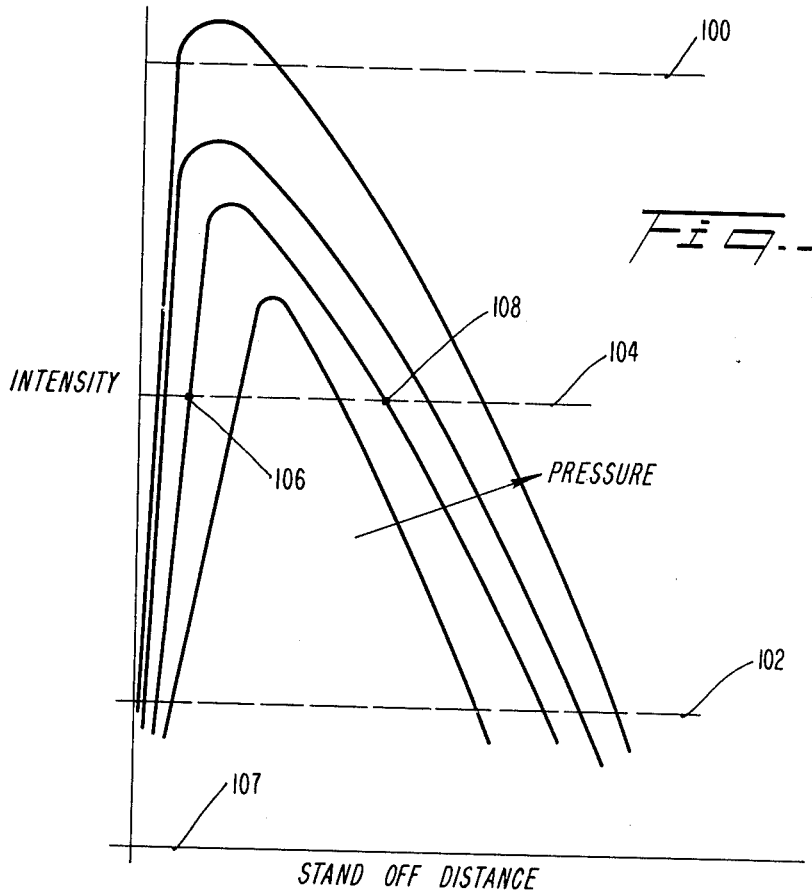
FIG. 4 is an illustration of the variation of erosion intensity versus stand-off distance for predetermined velicities.

Turning now to FIG. 1, a nozzle 20 is supplied with pressurized fluid through a conduit 22. The conduit 22 is provided with a suitable conventional pressure regulator 24 which is adjustable so as to control the upstream pressure of fluid advanced to the nozzle 20.

So that the operator can effectively regulate operation of the nozzle 20, a flow meter 26 and a pressure gauge 28 are interposed in the conduit 22 between the pressure regulator 24 and the nozzle 20. The flow meter 26 and the pressure gauge 28 provide corresponding readings of fluid mass flow rate and fluid pressure at a position close to the nozzle 20.

The pressure regulator 24 receives fluid from a suitable conventional pump means 30 which communicates with and receives fluid via a supply conduit 31 connected to fluid reservoir 32. The pump includes a bypass conduit 34 connected to the conduit 22 downstream thereof to the supply conduit upstream thereof. The bypass conduit 34 permits pressurized fluid from the pump outlet to pass therethrough and return to the supply conduit 31. The bypass conduit 34 is provided with a suitable conventional adjustable valve 36 to regulate the flow of fluid therethrough. The combination of the pressure regulator 24 and the adjustable valve 36 allow both the pressure and the mass flow rate of fluid from the pump reaching the nozzle to be adjusted.

Turning now to FIG. 2, a suitable nozzle 20 for use in connection with the system described above is illustrated. The nozzle 20 is provided with a sharp-edged orifice plate 40 at the downstream end thereof. The orifice plate 40 has an orifice opening 42 centrally positioned therein and having a predetermined diameter. As the pressurized fluid passes through the orifice 42, its flow parameters are maintained such that a cavitation inception parameter is not exceeded. In this manner, the fluid flowing through the orifice 42 does not generate a deleterious cavitational flow field adjacent to any solid structure of the nozzle 20. Accordingly, there will be no deleterious erosion of the nozzle 20 itself.

The velocity of the jet 44 emanating from the orifice 42 is, however, sufficiently high so that it creates a free turbulent shear layer 46 having extremely high transverse velocity shear gradients as it moves into the comparatively quiescent surrounding fluid 48. This very high velocity shear gradient induces a multiplicity of vortices in which the local velocity exceeds that value at which the static pressure of the fluid drops to the vapor pressure of the fluid. Accordingly, cavitation bubbles are generated in the free turbulent shear layer downstream of the orifice 42 and are then conveyed downstream by the fluid jet 44.

While the flat-plate orifice is preferred as it is cheaper to manufacture and maintain, it is also within the contemplation of the present invention to use a suitable conventional conical orifice with the nozzle 20 of FIG. 1. Turning to FIG. 3, a cross section of a typical conical nozzle suitable for use with this present invention is disclosed. One end of the conical nozzle 52 is provided with a mounting flange 54 and an orifice opening 56 is located in the second end thereof. The orifice opening 56 is centrally positioned in a comparatively flat disc-like portion 58 of the conical nozzle 52. Preferably, the inside diameter of the disc-like portion 58 is in the neighborhood of five times the diameter of the orifice 56. A suitable cone angle for the interior surface 60 of the conical nozzle is 60°. The exterior surface 62 of the conical nozzle is frustoconical in shape, has a cone angle exceeding 60° and is selected so as to provide sufficient mechanical strength to the conical nozzle 52. The frustoconical surface 62 terminates at the disc-like surface 58 at one end while it terminates at a cylindrical surface 64 at the other end. The cylindrical surface 64 accommodates a slip nut which attaches the nozzle assembly 20 to the conduit 21.

The operation of the flow field downstream of the conical nozzle is substantially identical to the flow field generated by the flat-plate orifice. Accordingly, a discussion of that flow field will not be repeated here, it being remembered that the operating parameters for the conical nozzle are also selected so as to establish a non-cavitating flow field within the orifice which develops into a cavitating flow field downstream of the orifice.

To fully understand the operation of the process and apparatus of the present invention, it is necessary to understand the mechanism whereby cavitation erosion occurs. During cavitation erosion, a volume of material is removed from the surface of the body undergoing erosion. This material removal has associated with it a certain energy absorption which varies from material to material. The energy absorption may be defined in a quantitative formula as follows: $E=\Delta V\times S$ where E is the energy absorbed by the material removed; $\Delta V$ is the volume of material removed and S is the energy absorbing strength of the material per unit volume under the action of cavitation forces.

Another parameter, the intensity of cavitation, is also useful in evaluating and utilizing a controlled cavitation erosion system. This parameter, intensity of cavitation, I, may be defined as the power absorbed by the material per unit area and may be expressed quantitatively as follows:

$$I=\Delta y/\Delta t\ S$$

where $\Delta y$ is the mean depth of the material being eroded and $\Delta t$ is the exposure time. Alternatively, the cavitation intensity may be considered to be the energy absorbed per unit area per unit time. This erosion intensity for the material is essentially the power which is used to actually erode a portion of a parent material with the cavitation mechanism. Given that the cavitation output intensity can be quantified, it can be shown that the intensity of a cavitating flow system if related to a product of the cavitation bubble diameter, the impact pressure generated by an imploding bubble, and the number of implosions which occur per unit time. Armed with the foregoing knowledge, we have demonstrated that the cavitation erosion intensity is a strong function of the physical standoff distance between the source of a cavitating flow field and an adjacent solid surface. Moreover, the cavitation output intensity is also a strong function of the upstream pressure supplying fluid to the cavitating flow field. FIG. 4 illustrates the kinds of variations which occur in the cavitation output intensity for variations of upstream fluid pressure and for variations in the standoff distance. It is to be noted, of course, that the cavitation output intensity is also a function of the diameter of the orifice which functions as the cavitational flow field generator.

Figure 5:
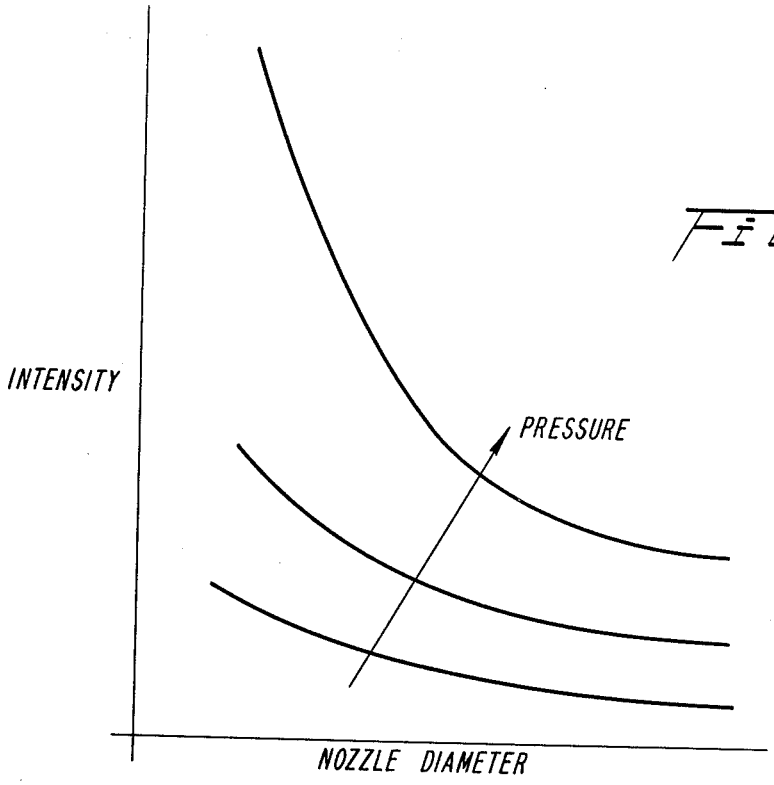
FIG. 5 is an illustration of erosion intensity versus orifice diameter for predetermined velocities.

It will be observed from FIG. 5 moreover that the maximum cavitation output intensity is a stronger function of nozzle diameter for higher upstream pressure levels. These factors are important when it comes to making a decision as to the appropriate nozzle diameter, upstream pressure, flow rate and standoff distance.

When it is desired, for example, to remove one material from a second material using the cavitation erosion system, while not deleteriously affecting the parent material, the threshold erosion intensity for both the parent material and the material to be removed must first be determined. In reference to FIG. 4, the threshold erosion intensity for the parent material might, for example, be at a level designated by the broken line 100. Similarly, the threshold erosion intensity for the material to be removed might, for example, lie on a level designated by the broken line 102. Any cavitation erosion intensity level which lies above the threshold 102 for the material to be removed yet below the threshold 100 for the parent material will be effective to remove the weaker material from the stronger material.

Returning now to FIG. 2, there is shown a parent material 110 which might, for example, be the hull of a seagoing vessel. The surface 110 may be covered by another material 112 which is to be removed. In a marine environment, barnacles and similar growth are examples of what might be attached to the surface 110. In other environments, such as boilers, the material 112 may be scale which has accumulated over a period of time on the interior surface of heat exchanger pipes.

With continued reference to FIG. 2, the nozzle assembly 20 is positioned with respect to the surface 110 at a standoff distance H. From FIG. 4, it will be apparent that at any given output cavitation intensity level, see for example broken line 104 which is selected between the lower threshold 102 and the upper threshold 100 and for a corresponding upstream pressure there will be two standoff distances 106, 108, between which the cavitation erosion intensity will exceed the selected value 104 for a specified pressure. The axial distance between the points 106 and 108 constitutes a distance $\Delta y$ within which cavitation erosion will proceed with at least the specified rate. This permissible axial distance is designated in FIG. 2 as "$\Delta y$". Where the centerline 41 of the nozzle assembly 20 is positioned at an angle $\theta$ with respect to the surface 110, the standoff distance H and the effective operating range $\Delta y$ are effectively shortened by a factor equal to the sine of the angle $\theta$.

When a pressure has been selected and a cavitation erosion intensity 104 (see FIG. 4) has been selected, the standoff distance 107 for the peak cavitation erosion intensity is specified. Accordingly, by positioning the nozzle assembly 20 (see FIG. 2) at a standoff distance H corresponding to the value designated by the point 107 on FIG. 4, the maximum cavitation erosion intensity can be directed to removal of the scale 112 from the surface 110. While the rudiments of the cavitation erosion intensity have thus been outlined, there are additional features of the cavitation generating nozzle assembly 20 that require further discussion. The cavitation flow field 44 must be established such that cavitation bubbles are generated downstream of the orifice plate 40. In this manner, imploding cavitation bubbles will not interact with and erode the nozzle assembly 20 itself. In order to assure this operation of the nozzle assembly 20 it is necessary to consider briefly a dimensionless number conventionally used in discussions of cavitating flow fields, namely the cavitation number $\sigma$. The cavitation number $\sigma$ for the orifice opening is preferably selected to be greater than a cavitation inception number $\sigma_i$ for that orifice opening. The cavitation number $\sigma$ is classically defined as follows:

$$\sigma=(p_0-p_v)/(\tfrac{1}{2}\rho V_0^2)$$

where $p_0$ is a total pressure of the fluid downstream of the orifice opening; $p_v$ is the fluid vapor pressure; p is the weighted average fluid density; and $V_0$ is the average fluid velocity through the orifice. The cavitation inception number, $\sigma_i$ is an empirically determined quantity for a particular geometric configuration and is the threshold at which cavitation commences. By purposely selecting an orifice diameter and flow conditions so that the cavitation number $\sigma$ exceeds the cavitation inception number $\sigma_i$, cavitationally induced erosion of the orifice is essentially precluded.

The cavitation flow field is established by vortices generated by the high velocity gradients in a direction transverse of the centerline 41. These velocity gradients induce annular vortices in the downstream flow field. In accordance with conventional laws of fluid mechanics, velocities within these annular vortices exceed that value where the pressure locally is reduced below as a fluid vapor pressure. Accordingly, at these points, local bubbles form and are conveyed downstream in the direction of the centerline 41 by the jet of fluid emanating from the orifice 42. When these cavitation bubbles encounter the material 112 to be removed from the surface 110, their collapse generates large pressures which erode the material 112 from the surface 110.

Generally, the pressure downstream of the orifice 42 lies in the range of 120 psig to 0 psig. For these values, a cavitation number downstream of the orifice 42 can be calculated and generally lies in the range of 0.001 to 0.0100. For conical orifices, it has been determined that a value of 0.001 is preferable. As the value of the upstream cavitation number must exceed the cavitation inception parameter in order to avoid cavitation erosion of the nozzle, the necessary upstream pressure may then be computed. While the downstream cavitation parameter was computed, a fluid flow velocity through the orifice was also required. Knowing this velocity, the mass flow rate for that particular orifice is determined. Having these parameters, predetermined, the pressure regulator 24 (see FIG. 1) and the bypass valve 36 may be appropriately adjusted to give the necessary readings on the pressure gauge 26 and the flow meter 28. With the apparatus thus adjusted, the nozzle assembly 20 can be moved parallel to the surface 110 (see FIG. 2) and remove the scale 112 at a highly efficient rate.

There are other embodiments of the nozzle assembly 20 which can be used with great advantage. For example, in reference to FIG. 6, a nozzle assembly 20 is illustrated which is adapted for use in removing the scale 122 from the interior of a heat exchanger pipe 124. The nozzle assembly includes a body portion 126 having four individual nozzles 128 threadably connected thereto and in fluid communication with a central channel 130. The central channel 130 includes a pair of cross channels 132, 134 which are mounted perpendicularly with respect to one another and are axially offset from one another. Each of the cross channels 132, 134 terminates in a pair of the orifice assemblies 128.

Figure 8:
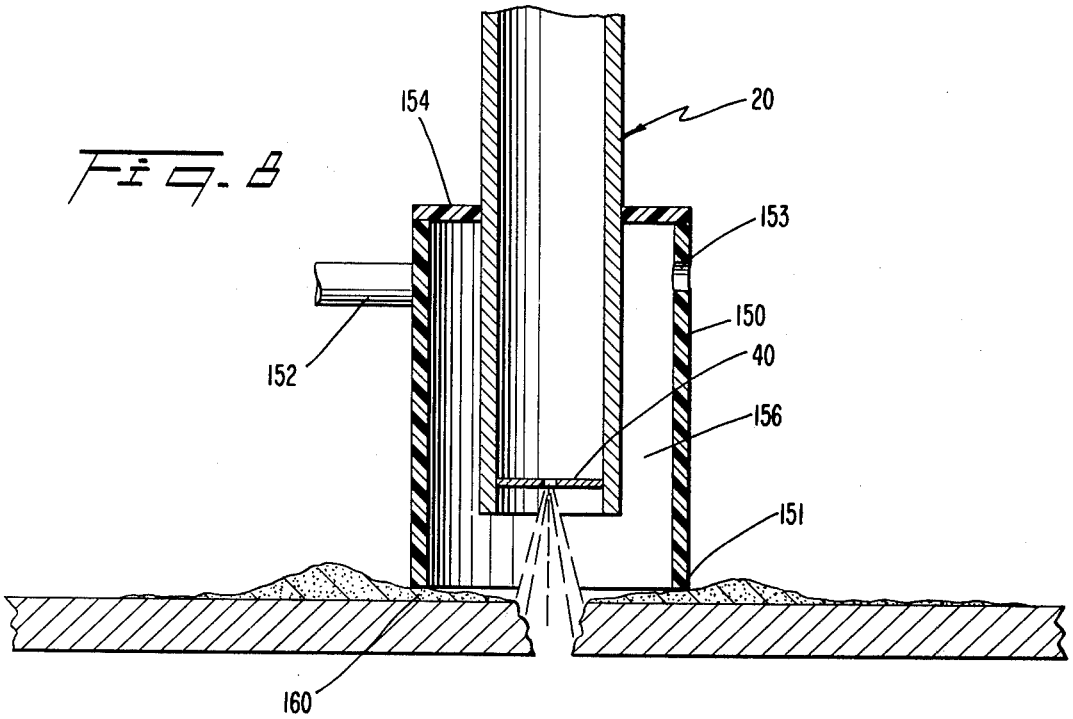
FIG. 8 is a partial cross-sectional view of a nozzle embodiment suitable for cutting in a gaseous environment.

As seen in FIG. 7, the four nozzle assemblies 128 direct a cavitating flow field in a generally radial direction to encounter and remove the scale 122. The body 126 is provided with a flanged portion 138 at one end which is received by a slip nut 140 and compressed against a suitable conventional seal 142. In this manner, fluid being advanced through the conduit 144 is directed to the nozzles 128 so as to develop a cavitating flow field downstream thereof. By positioning the nozzles 128 at opposing ends of lateral channels 132, 134, a dynamically balanced flow arrangement is provided in the nozzle assembly so that the nozzle assembly will tend to be centered in the tube 124.

Where it is desired to use the nozzle assembly 20 where it is not submerged, a generally cylindrical shroud 150 (see FIG. 8) may be attached to the nozzle assembly 20.

The shroud 150 is generally cylindrical in cross section and extends from a position upstream of the nozzle assembly; orifice plate 40 to a position downstream of the nozzle. The upstream end of the shroud 150 is attached to a resilient diaphragm 154 which is fastened in a fluid tight manner to the upper peripheral edge of the shroud 150. Similarly, the resilient member 154 is attached its inner circumference to the peripheral surface of the nozzle assembly 20. Typically, the resilient diaphragm 154 is annular in plan view and may be fashioned from rubber or any other suitable conventional resilient material. In any event, the member 154 has sufficient stiffness to hold the cylindrical shroud 150 in generally coaxial alignment with the nozzle assembly 20. The shroud preferably includes one or more ports 153 which are operable to regulate the height of the fluid column inside the shroud 150, thereby regulating the hydraulic pressure.

In order to provide a bath of fluid into which the nozzle assembly may discharge, a conduit 152 supplies fluid to the interior region of the shroud 150. It will be noted that the resilient member 154 and the annular shroud 150 define a substantially enclosed chamber 156 which can be filled with fluid from the conduit 152. With the shroud 150 spaced from the surface 158 by a small axial distance, the fluid in the chamber 156 can exhaust through a circumferential gap 160 between the distal end of the shroud 150 and the surface 158. Accordingly, the flow rate of fluid into the chamber 156 through the conduit 152 and through the nozzle assembly 20 must be equated with the volumetric flow rate of fluid passing radially outwardly through the gap 160.

The positioning of the distal end 151 of the annular shroud 150 with respect to the plane of the orifice plate 40 is selected so as to define the distance H discussed above and to position the nozzle orifice plate 40 so as to accomplish the desired task.

Figure 9:
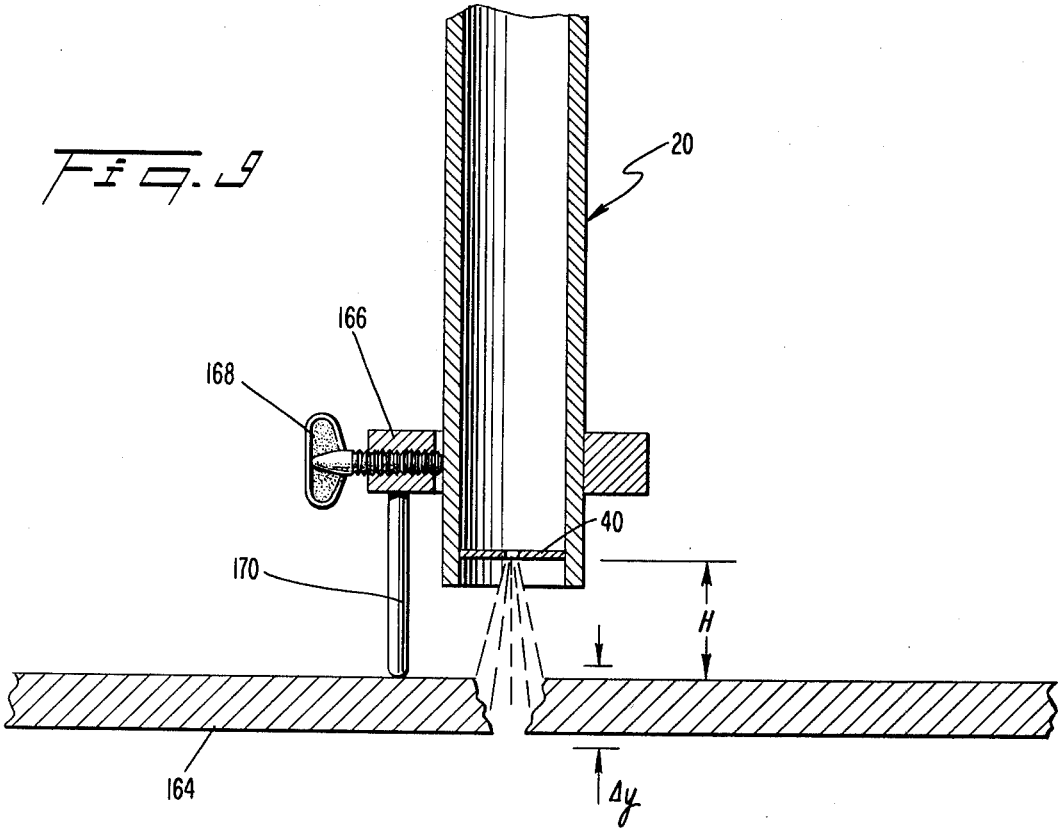
FIG. 9 is a partial cross sectional view of a submerged cutting nozzle, similar to FIG. 8.

Turning now to FIG. 9, an alternate embodiment for positioning the nozzle assembly 20 and the orifice plate 40 thereof from a surface 164 is illustrated. In the embodiment disclosed in FIG. 9 an annular collar 166 may be circumferentially disposed around the nozzle assembly 20 and releasably connected thereto by means of a disposed thumb screw 168. By attaching a feeler gauge 170 directly to the annular ring 166, the positioning of the orifice plate 40 above the surface 164 may be readily maintained. The feeler gauge 170, by means of the thumb screw 168, is axially adjustable so as to facilitate adjustment of the nozzle assembly relative to the surface 164. In operation, the adjustable feeler gauge of FIG. 9 is best adapted for use in a submerged operation.

Turning now to FIG. 10 a bucket for use in a submerged trenching operation is disclosed. The remaining portions of a trenching device are omitted for the sake of clarity. Along the lower edge 172 of the bucket 174 are positioned a plurality of controlled cavitation erosion nozzle assemblies 176, 178, 180. In operation, the cavitation erosion assemblies 176, 178 and 180 exhaust jets of turbulent fluid which cavitates in the direction forward of the bucket 174.

Figure 11:
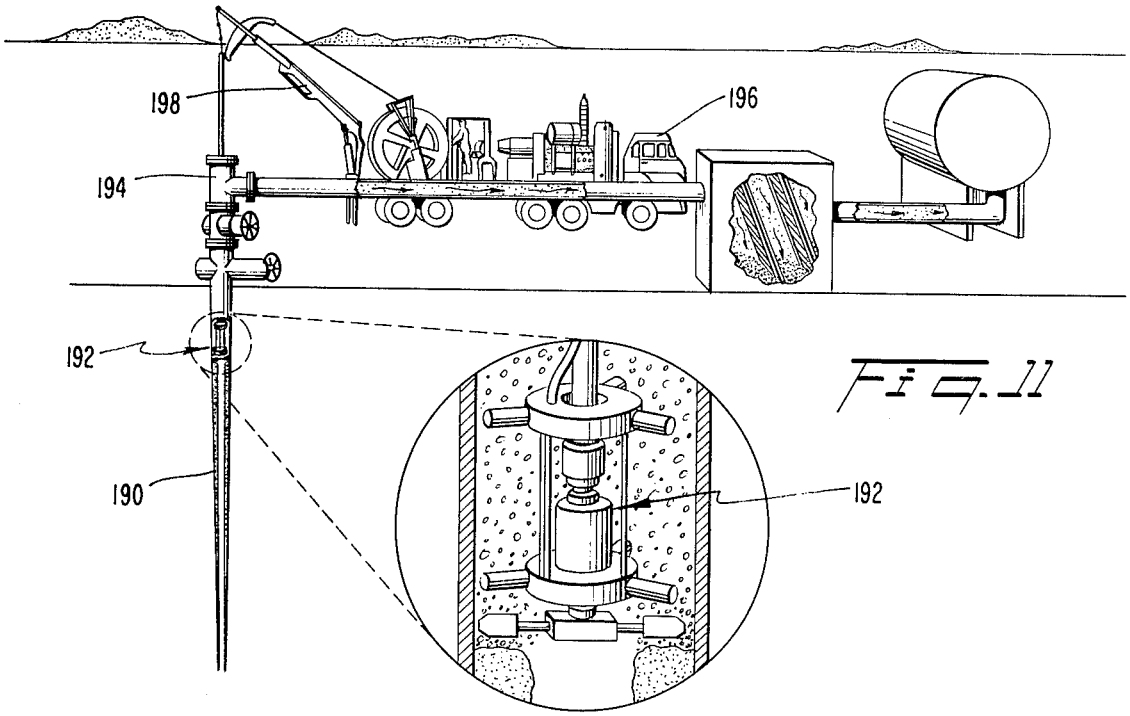
FIG. 11 is a pictorial view of a down hole well cleaning system.

The process of the present invention may also be practiced for the purpose of removing deposits from the walls of oil exploration wells and the like. For example, a well 190 (see FIG. 11) may be cleaned by using a mole 192 which enters through a well head 194. The mole 192 may be transported by a truck 196 having a suitable derrick 198 for positioning and supporting the mole 192 while it is in use.

Figure 12:
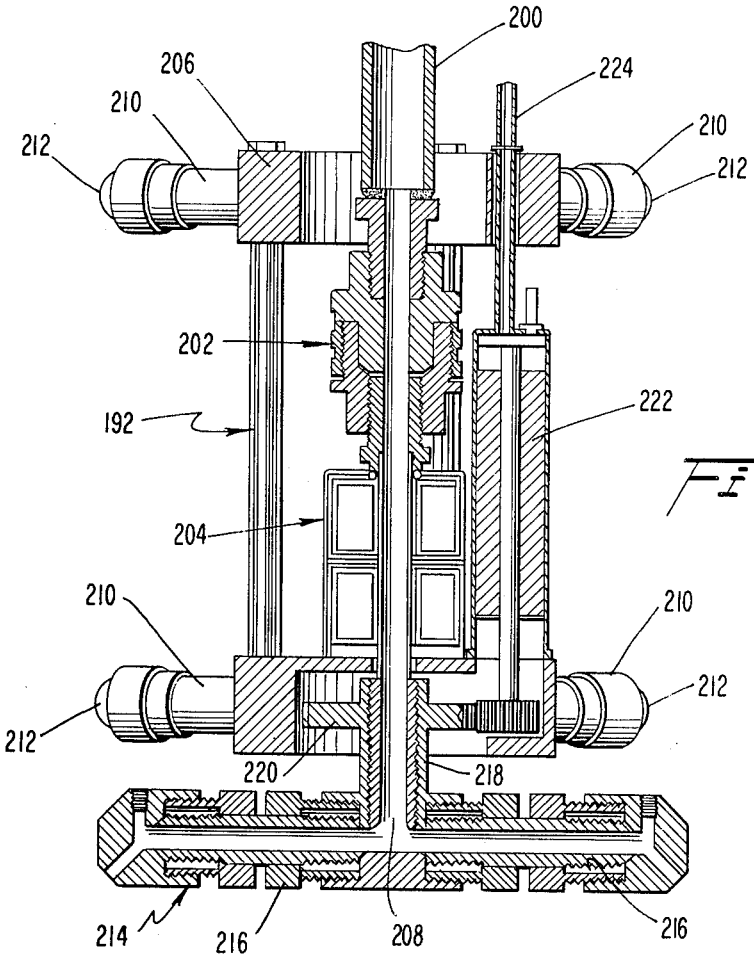
FIG. 12 is a longitudinal cross-sectional view taken through the cleaning apparatus of FIG. 11.

The mole 192 is suspended from a conduit 200 (see FIG. 12) in the well by the use of a quick release coupling 202 which facilitates assembly and disassembly of the box cleaning device at the site. A rotary seal 204 connects a skeleton 206 with the coupling 202 such that an internal passage 208 is in fluid communication with the conduit 200. Each end of the skeleton 206 includes a plurality, e.g., three, of generally radially extending arms 210. Each arm 210 has a guide bearing 212 at the distal end thereof. The arms 210 and the associated guide bearings 212 cooperate to position the mole inside the well. As desired, the arms 210 may be adjustable in length so as to be operable in wells of different inside diameter.

At the end of the skeleton 206, remote from the conduit 200, is a rotary head 214 with a pair of fingers 216 having internal passages which communicate with the passage 208. The head 214 has a shaft 218 for support, which shaft is connected to the rotary coupling 204 and is driven through a gearing arrangement 220. A fluid driven motor 222 is attached to the skeleton 206 and is supplied with motive fluid, e.g., water, through an inlet 224 by a suitable conventional conduit extending to the top of the well. The motor 222 drives the gearing arrangement 220 causing the head 214 to rotate relative to the skeleton 206 and relative to the well.

Fluid exhausts from the fingers 216 under the conditions set forth herein so as to establish a cavitating flow field and erode any deposits from the well without damaging the well conduit itself. In this connection, the tip to tip distance across the fingers 214 is slightly less than the inside diameter of the well itself.

In operation, one material may be selectively removed from a second material, for example, in a cleaning operation, by first predetermining the orifice size to be used. With the orifice size being known, the orifice of the orifice plate 40 (see FIG. 2) is positioned at a predetermined distance H from the material to be removed. This predetermined distance H is selected in accordance with the desired cavitation erosion intensity and the pressure of fluid to be advanced through the nozzle assembly itself.

Subsequently, the pump 30 advances a pressurized flow of fluid, such as water, through the pressure regulator 24 to the nozzle assembly 30 (see FIG. 1) as the water exhausts through the orifice 42 of the orifice plate 40, it generates a high velocity jet defined by the boundaries 46 (see FIG. 2). The boundaries of the jet 46 when submerged, define extremely high transverse velocity gradients which create vortices within which a cavitating flow field is developed. With the cavitating flow field generated, there are a plurality of bubbles located between the orifice plate 40 and the surface 110 which is to be cleaned.

With the cavitation free flow through the nozzle orifice 42, the flow velocity is adjusted so as to provide the desired cavitation erosion intensity. The desired cavitation erosion intensity is selected to exceed the threshold erosion intensity of the material to be selectively removed. In the context of FIG. 2, the material to be removed would be the marine growth 112 on the exterior portions of the surface 110.

As the cavitating flow field defined by the boundaries 46 advances toward the material to be removed 112, the bubbles collapse adjacent the material and the pressure shocks associated with the implosion of the cavitation bubbles causes the material to be loosened, removed and eroded.

By selecting the cavitation erosion intensity, so that it does not exceed the threshold cavitation erosion intensity of the solid surface 110 underlying the growth to be removed 112, the material will be cleaned from the underlying parent material while avoiding cavitation erosion damage to the parent material.

On the other hand, if the nozzle assembly 20 is positioned (see FIG. 9), directly above the surface 164 with the foregoing flow conditions having been established, by advancing the nozzle assembly toward the surface 164, the submerged cavitating flow field will erode a hole through the material 164.

When it is desired to make a cut through a particular material, the cavitation erosion intensity generated by the nozzle assembly 20 is selected to be above the threshold erosion intensity of the material to be cut. Again with reference to FIG. 9, the nozzle standoff distance H and the intercepts with the selected cavitation erosion intensity (see FIG. 4) are selected such that the distance between the intercepts on FIG. 4 for the preselected cavitation erosion intensity is greater than the thickness of the plate 164. In this manner, the cavitation flow field developed downstream of the nozzle assembly 20 has sufficient intensity throughout its length in order to erode material from the plates 164 throughout the entire thickness of the plate. With the orifice 40 thus positioned, the orifice plate 40 may be moved generally parallel to the surface of the body along a preselected contour. In this manner, the cavitating flow field downstream of the nozzle assembly will erode through the plate 164 so as to cut through the plate.

Where it is desired to perform a trenching operation, a plurality of nozzle assemblies may be mounted in spatially fixed relation to a frame or bucket portion of an underwater trenching device. With the bucket or frame advanced toward a submerged surface, a trench having a cross section defined by the spatially fixed nozzles will be eroded.

The advantages of the present invention are numerous. Among those advantages, is the very low specific energy input required for a controlled cavitation erosion cutting system. For example, the specific energy in joules per cubic centimeter required by this inventive system is in the range of 60 to 100 when cutting medium strength rock. The maximum potential drilling rate in terms of centimeters per minute is on the order of 10. This rate compares favorably with and is second only to that rate provided by a rotary drill.

The inventive system is also free from the problems of wear which are necessitated with mechanical kinds of cutting systems. Accordingly, there are no expensive parts to replace frequently during operation of the system.

It will be apparent to those skilled in the art that there has been provided a novel system and apparatus for effectively controlling the erosion of materials in a useful fashion. Moreover, it will be apparent to those skilled in the art that there are numerous modifications, variations, substitutions and equivalents which may be made for the features of the invention as described herein. Accordingly, it is expressly intended that all such modifications, variations, substitutions and equivalents which fall within the spirit and scope of the appended claims be embraced thereby.

What is claimed is:

1. A method of selectively removing material from a solid body comprising the steps of:

positioning an orifice of a predetermined size at a distance from the material to be selectively removed;

generating a fluid flow through the orifice such that the cavitation number at the orifice exceeds the cavitation inception number for that orifice and such that a submerged cavitating flow field having bubbles is established in a body of the fluid between the orifice and the material to be removed;

adjusting the flow velocity through the orifice to provide a selected cavitation intensity that exceeds the threshold erosion intensity of the material to be selectively removed; and allowing the bubbles to collapse adjacent to the material to be removed to selectively loosen and remove the material.

2. The method of claim 1, further including the step of:

advancing the orifice of the predetermined size toward the material to be removed at a rate which maintains the distance from the orifice to the material substantially uniform so that the submerged cavitating flow erodes a hole.

3. The method of claim 1, further including the steps of:

positioning the orifice of the predetermined size such that the associated cavitation intensity for the determined flow velocity at any distance extending from the nozzle to a point within the thickness of a solid body exceeds a selected cavitation intensity such that submerged cavitating flow will erode a hole; and moving the orifice generally parallel to a surface of the solid body so that the submerged cavitating flow cuts the solid body.

4. The method of claim 1, further including the steps of:

mounting a plurality of orifices of the determined size in spatially fixed relation to a frame; and advancing the frame relative to a submerged surface so as to erode a trench having a cross section defined by the spatially fixed relation of the plurality of orifices to the frame.

5. The method of claim 1, wherein the step of:

adjusting the flow velocity also provides a cavitation intensity that is less than the threshold erosion intensity of a solid body supporting the material to be removed so that the submerged cavitating flow will clean the material to be selectively removed from the solid body while avoiding erosion of the solid body.

6. The method of claim 5 including the step of:

attaching a feeler gauge to the orifice structure; and adjusting the feeler gauge relative to the orifice structure at the selected distance from the material to be selectively removed.

7. The method of claim 5 including the steps of:

providing a plurality of radially directed nozzles, each having an orifice, at the end of a conduit to provide a dynamically balanced flow therefrom;

feeding the conduit into a pipe of larger diameter so as to remove a secondary material from the inside of the pipe.

8. The method of claim 5 including the steps of:

mounting a plurality of orifices in a rotary head of a mole;

lowering the mole into a pipe; and rotating the head to selectively erode deposits from the inside of a the pipe as the mole is lowered.

9. The method of claim 1 wherein the generating step includes the steps of:

selecting a cavitation number downstream of the orifice in the range of 0.01 to 0.001;

selecting a corresponding flow rate and upstream pressure to provide a cavitation number at the orifice which exceeds the cavitation inception number for the orifice so that cavitation occurs downstream of the orifice; and setting a pressure regulator and pump bypass upstream of the orifice to yield the selected upstream pressure and the selected flow rate at the orifice so that flow through the nozzle and the orifice are cavitation-free.

10. The method of claim 9, further including the step of operating the orifice in a submerged environmental where the pressure is no greater than 120 psig.

11. The method of claim 9 including:

using a conical orifice for generation of the fluid flow; and selecting the cavitation number downstream of the orifice to be 0.001.

12. A method of removing one material having a first threshold erosion intensity from a second material having a second threshold erosion intensity exceeding the first erosion intensity, comprising the steps of:

selecting a cavitation intensity which lies between the first threshold intensity and the second threshold intensity;

generating a cavitating flow field submerged in a liquid and directed at the one material; and operating the cavitating flow field at the selected cavitation intensity.

13. A method of selectively removing a material having a threshold erosion intensity in a submerged environment having a known pressure comprising the steps of:

providing a pressurized liquid supply system having an adjustable pressure regulator and a nozzle assembly having an orifice with a predetermined cavitation inception number;

connecting the pressure regulator between the liquid supply system and the nozzle;

positioning the nozzle at a predetermined distance from the material to be removed in the submerged environment;

adjusting the bypass and the pressure regulator so that (a) the nozzle operating pressure and the nozzle flow rate define an upstream cavitation number exceeding the cavitation inception number for the orifice, (b) the known submerged pressure and the nozzle flow rate define a downstream cavitation number less than the cavitation inception number, and (c) the cavitation intensity at the predetermined distance from the nozzle exceeds the threshold erosion intensity whereby a cavitating flow field is only developed downstream of the orifice; and allowing vapor bubbles of the cavitating flow field to collapse at the material to be removed to selectively loosen and remove the material.

14. The method of claim 13 wherein the adjusting step includes setting the nozzle flow rate such that the downstream cavitation number lies in the range of 0.01 to 0.001.

15. The method of claim 14 wherein the submerged environment has a pressure less than 120 psig.

16. The method of claim 13 wherein the first material is carried by a second material having a second threshold erosion intensity which exceeds threshold erosion intensity of the first material and wherein the adjusting step includes setting the nozzle operating pressure and nozzle flow rate such that the cavitation intensity at the predetermined distance is also below the second threshold erosion intensity so that only the first material is removed.

17. The method of claim 16 including the further step of moving the nozzle assembly through a pipe fashioned of the second material to remove the first material therefrom.

* * * * *